United States Patent [19]

Azuma

[11] 4,177,532

[45] Dec. 11, 1979

[54] ROTARY BRUSH

[76] Inventor: Shinsuke Azuma, 6020 Lindley Ave., Encino, Calif. 91316

[21] Appl. No.: 947,470

[22] Filed: Oct. 2, 1978

[51] Int. Cl.[2] ..... A46B 13/06

[52] U.S. Cl. ..... 15/24; 173/169

[58] Field of Search ..... 15/23, 24, 28, 29, 97; 173/168, 169

[56] References Cited

U.S. PATENT DOCUMENTS

| | | | |
|---|---|---|---|
| 1,171,755 | 2/1916 | Smith et al. | 15/24 |
| 1,208,713 | 12/1916 | Roland | 15/24 |
| 1,641,494 | 9/1927 | Joseph | 15/24 |

*Primary Examiner*—Edward L. Roberts

*Attorney, Agent, or Firm*—William C. Babcock

[57] ABSTRACT

Disclosed herein is a device attachable by way of a flexible conduit to the hot and cold water outlets found in a home, the device comprising a hollow handle structure provided with a cylindrical interior insert which communicates the water from the flexible hose to impinge onto the paddles of a plurality of pelton wheels mounted on a rotary shaft. The pelton wheels then drive the shaft in rotation, the shaft being geared by way of a pinion gear to an output sleeve to which a rotary brush is attached. The spend water is then passed through the sleeve into the brush. Included further in the handle is a control mixture arrangement for controlling the mix of warm and cold water passed therethrough.

3 Claims, 4 Drawing Figures

ROTARY BRUSH

BACKGROUND OF THE INVENTION

1. Field of the Invention

The present invention relates to household devices and more particularly to an attachment useful with a household faucet which at the end thereof is provided with a rotary brush.

2. Description of the Prior Art

Rotary brushes driven by water have been known in the past. In most instances such prior art devices utilize turbines or other fan-like structures for providing the rotary motive power to turn a brush. The brush was then used for scrubbing dishes and other food utensils entailing periodic contacts with the dish or utensil in the course of this use.

Heretofore most prior art devices of this kind lacked the requisite power to achieve effective scrubbing particularly since the normal water flow and pressure entailed are usually limited in a household.

SUMMARY OF THE INVENTION

Accordingly, it is the general purpose and object of the present invention to provide a rotary brush device driven by the water flow available in a household, wherein the flow is arranged into a cylindrical cavity to increase the angular momentum of the driven brush.

Yet additional objects of the present invention are to provide a rotary brush device which by virtue of its arrangement dissipates substantially all of the pressure head available in the water supply.

Yet further objects of the invention are to provide a rotary brush applicator which by virtue of its structural arrangement it is convenient in use and may be insertable into narrow cavities.

Briefly these and other objects are accomplished within the present invention by providing a substantially hollow handle structure, attached at one end to a flexible conduit communicating through a mixture control valve with the hot and cold water outlet of a household, the handle structure including on the interior thereof a cylindrical casing sealed on the upstream end, the casing including a plurality of longitudinal bores in the wall thereof each bore terminating in a radially directed internally aligned output port for driving a pelton wheel at various stations therealong. The pelton wheels are mounted in common on a central shaft, each wheel being separated from the adjacent wheels by separating discs. The casing, furthermore, includes at the station of each pelton wheel, an exit window through which the spent water escapes. The shaft, in turn, is geared through an idler gear arrangement to a drive gear which turns a sleeve at the downstream side of the handle, the sleeve being provided with threads to secure a brush thereto.

In this manner each pelton wheel acts as an inertia wheel, the water trapped therein adding to the overall angular inertia of the device. Thus the total inertia of the brush rotation device is increased by the weight of the water allowing for the development of high scrubbing forces until the inertia is spent.

DESCRIPTION OF THE PREFERRED EMBODIMENT

Figure 1:
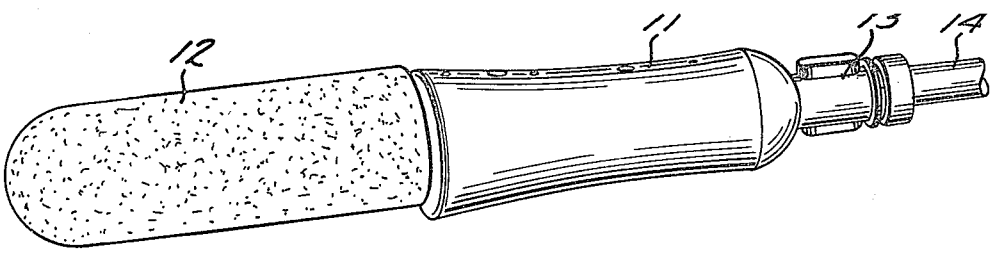
FIG. 1 is a perspective illustration of a rotary brush applicator constructed according to the present invention.
Figure 2:
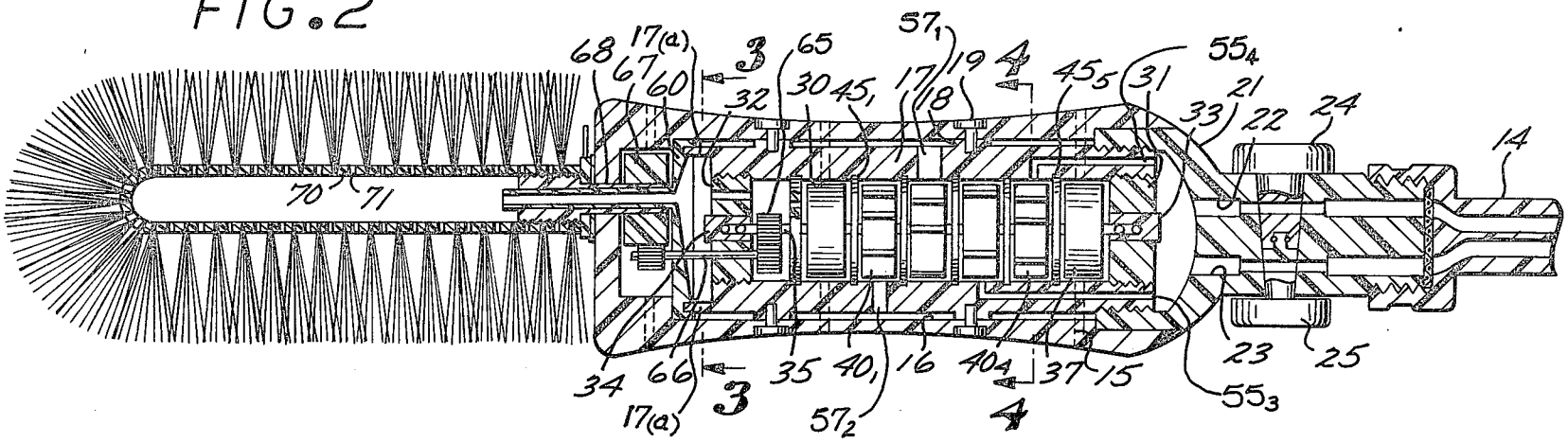
FIG. 2 is a sectional view taken along a longitudinal parting line of the inventive brush applicator disclosed herein.

As shown in FIGS. 1 and 2, the inventive brush applicator, generally designated by the numeral 10, comprises a handle 11 attached at one end to a rotary brush assembly 12 and at the other end to a valve housing 13 connected to a flexible conduit 14 which, in turn, is tied to the hot and cold water outlets of a conventional household (not shown).

The handle itself is substantially cylindrical in shape, and lateral exterior surface slightly concave for convenience in grasping. This exterior surface is formed in the exterior of a hollow outer housing 15 which on the interior encloses a cylindrical cavity 16 in which a tubular casing 17 is received. Casing 17 is attached to the interior surface of cavity 16 by way of plurality of stand offs 18, each secured by a corresponding screw 19 extending through the handle. In this manner a peripheral cavity is formed between the interior surface of cavity 16 and the exterior surface of the casing 17 through which water may flow.

At the inlet end casing 17 is inserted and threadably engaged into the interior of an end cap 21 which is also conformed on its exterior to provide a sealing fit with the proximate end of the housng 15. End cap 21 forms a dome like end structure enclosing the end of casing 17 and communicating by way of two ports 22 and 23 with the aforementioned valve housing 13. Valve housing 13 includes the necessary valves 24 and 25 which regulate the flow through port 22 and 23. Thus the water conveyed into the dome formed on the interior of vent cap 21 may be controlled, the flow continuing therefrom according to the description followed.

Figure 4:
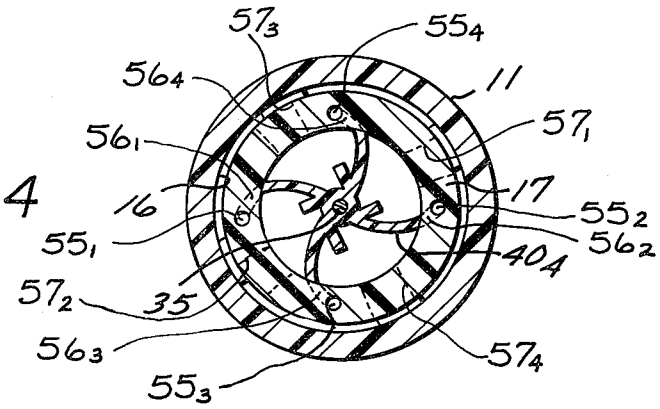
FIG. 4 is yet another end view, in section, taken along line 4—4 of FIG. 2.
Figure 3:
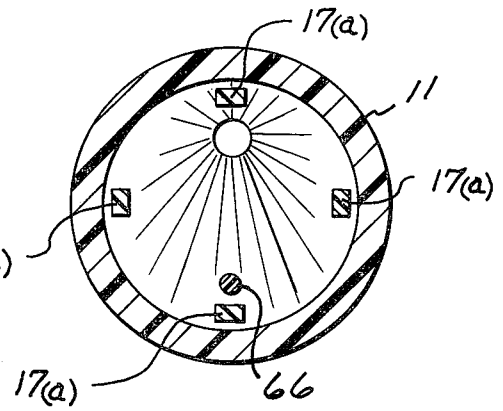
FIG. 3 is an end view, in section, taken along line 3—3 of FIG. 2.

More specifically as shown in FIGS. 2, 3 and 4, casing 17 includes a central bore 30 on the interior thereof, bore 30 being closed off at the upstream end by way of a plug 31 and by way of a perforated plug 32 at the downstream end thereof. Plugs 31 and 32 each include centrally located threaded inserts 33 and 34 for which support in rotation a central shaft 35. Shaft 35, proximate either end, is provided with a fly wheel 36 and 37 which increase the inertia thereof. Between these fly wheels, shaft 35 supports a plurality of pelton wheels $40_1$ through $40_4$ separated by discs $45_1$ through $45_5$ which thus form around each pelton wheel a closed cavity.

Each of the cavities communicates with the end cap 21 by way of a corresponding longitudinal bore $55_1$ through $55_4$, bores $55_3$ and $55_4$ being exemplary herein. Bores $55_1$ through $55_4$ extend through the wall of the casing 17 conveying water under pressure into each cavity. Each bore, furthermore, terminates in a tangentially aligned exit nozzles communicating with the cavity it is shown herein as exit nozzles $56_1$ to $56_4$, and it is the water flow through these exit nozzles that provides the necessary impingement on the blades of the pelton wheel.

In this manner a full pelton wheel cavity is rotating along with the blades thereof, increasing the momentum by the weight of the water stored therein. The water, injected through the aforementioned bores, is ejected outwardly through corresponding windows $57_1$ through $57_4$ into the inter-spacial cavity between the housing 11 and the casing 17. It is through this means that the water is then brought down around the exterior of the casing to an exit nozzle 60 seated in the downstream end of the handle. It is this nozzle 60 that closes off the lower end of cavity 16 and communication therewith is provided by way of four end legs 17(*a*) on the casing 17. Thus the water ejected through the windows $57_1$ through $57_4$ passes around the exterior surface of the casing 17 and around the legs to the nozzle 60. In the course of this passage, the pelton wheels $40_1$ through $40_4$ are driven in rotation, driving shaft 35 therealong. Shaft 35 is provided with a drive gear 65 at the downstream end thereof which is geared to an idler shaft 66 driving an output gear 67 on the underside of nozzle 60. More specifically, gear 67 is arranged coeccentrically around the exterior of the nozzle 60 being engaged to an annular sleeve 68 extending to the exterior of the housing. Sleeve 68, on the exterior, terminates in a threaded segment which may be engaged to a cylindrical support 70 forming the structure for brush 12. This cylindrical support 70 may be provided with a plurality of openings 71 which are interspaced between the various brush hairs to thus distribute the water therealong.

It is to be understood that the foregoing structure adds to the inertia of the fly wheel 36 and 37, the trap inertia of the water around each pelton wheel. Thus the angular momentum of the brush is substantially increased without increasing the radius thereof.

Accordingly, a brush of substantially narrow dimensions and thus insertable in various small dishes is now driven by a high inertia device and will therefore maintain rotation over long periods against contact friction.

Some of the many advantages of the present invention should now be readily apparent. As set out, the invention provides a high inertia and very efficient drive arrangement through which most of the potential energy of the water normally available to a household is taken out to drive the brush. When taken out the spent water is then directed to the interior of the brush supports to be ejected by rotation along the brush hairs and thus effect cleaning.

Obviously many modifications and changes may be made to the foregoing description without departing from the spirit of the invention. It is therefore intended that the scope of the invention be determined solely by the claims appended hereto.

What is claimed is:

1. A rotary brush device adapted to be attached to a home water outlet comprising:

a hollow substantially tubular handle structure;

a substantially tubular inner casing received on the interior of said handle structure, said casing including a plurality of stand offs formed on the exterior peripheral surface thereof for separating said casing from said handle;

valve means attached to one end of said handle structure and connected to said outlet;

an end cap deployed between said handle structure, said casing and said valve means for defining a first cavity communicating between said casing and said valve means, a second cavity being defined between said casing and said handle structure and a third cylindrical cavity being formed on the interior of said casing, said casing including a plurality of longitudinal bores extending from said first cavity into the wall thereof each terminating in a tangential port directed into said third cavity at selected axial locations;

a plurality of pelton wheels mounted for common rotation on a central shaft and deployed on the interior of said third cavity in alignment with corresponding ones of said ports;

a plurality of separators interposed between said pelton wheels in said third cavity;

a plurality of windows formed in said casing in corresponding alignment with said pelton wheels, said windows communicating between said second and third cavities for permitting the outward escape of fluid from said wheels into said second cavity;

a nozzle closing off the other end of said handle structure and communicating with said second cavity;

a sleeve rotatably mounted on the exterior of said nozzle;

a driven gear attached to said sleeve;

gearing means disposed in said nozzle and engaged between said driven gear and said shaft; and a brush attachable to said sleeve.

2. Apparatus according to claim 1 wherein:

said brush includes a hollow support member attachable to said sleeve and bristles attached to the exterior of said support member and openings formed in said support member between said bristles.

3. Apparatus according to claim 2 wherein:

said valve means includes regulating valves for controlling the flow rate therethrough.

* * * * *